US007341081B1

(12) United States Patent
Villiger

(10) Patent No.: US 7,341,081 B1
(45) Date of Patent: Mar. 11, 2008

(54) HORIZONTAL HOLD DOWN JIG

(76) Inventor: Eric J. Villiger, 7904 W. 100th St., Palos Hills, IL (US) 60465

( * ) Notice: Subject to any disclaimer, the term of this patent is extended or adjusted under 35 U.S.C. 154(b) by 0 days.

(21) Appl. No.: 11/581,897

(22) Filed: Oct. 17, 2006

(51) Int. Cl.
*B27C 1/12* (2006.01)

(52) U.S. Cl. ..... 144/253.8; 144/253.1; 83/447; 83/449

(58) Field of Classification Search ..... 144/253.1, 144/253.6, 253.8, 253.5; 83/446–450
See application file for complete search history.

(56) References Cited

U.S. PATENT DOCUMENTS

| | | | | |
|---|---|---|---|---|
| 13,354 | A | 7/1855 | Hull | |
| 103,677 | A | 5/1870 | Stilwell | |
| 1,270,653 | A | 6/1918 | Otto | |
| 1,405,599 | A | 2/1922 | Lane | |
| 2,612,914 | A | 10/1952 | Reynolds | |
| 3,738,403 | A * | 6/1973 | Schwoch et al. | 144/250.15 |
| 4,026,173 | A * | 5/1977 | Livick | 83/421 |
| 4,132,256 | A | 1/1979 | Jones | |
| 4,469,318 | A * | 9/1984 | Slavic | 269/91 |
| 4,476,757 | A | 10/1984 | Morris | |
| 4,976,298 | A * | 12/1990 | Gibson | 144/250.15 |
| 5,058,474 | A * | 10/1991 | Herrera | 83/447 |
| 6,170,372 | B1 | 1/2001 | Weaver | |
| 7,017,464 | B2 | 3/2006 | Coderre | |
| 2002/0162439 | A1 | 11/2002 | Fontaine | |
| 2004/0250892 | A1 | 12/2004 | Fontaine | |
| 2004/0250902 | A1 | 12/2004 | Kimmel et al. | |
| 2006/0201297 | A1 * | 9/2006 | Friend | 83/436.1 |

* cited by examiner

*Primary Examiner*—Shelley M. Self
(74) *Attorney, Agent, or Firm*—Michael McKenna; Patrick Burkhart

(57) ABSTRACT

A horizontal rotary hold down jig for use in horizontally guiding a piece of wood to be cut on one of a portable table saw and a portable router table comprising a spring biased rotatable wheel that can be secured to the table. The spring biasing can be adjusted to provide uniform or enhanced pressure through use of a plurality of substitutable compression springs of varying compressive strength characteristics to laterally stabilize a piece of wood of varying consistency, wood grain angle, feed cutting speed, width, and thickness or depth of cut.

20 Claims, 3 Drawing Sheets

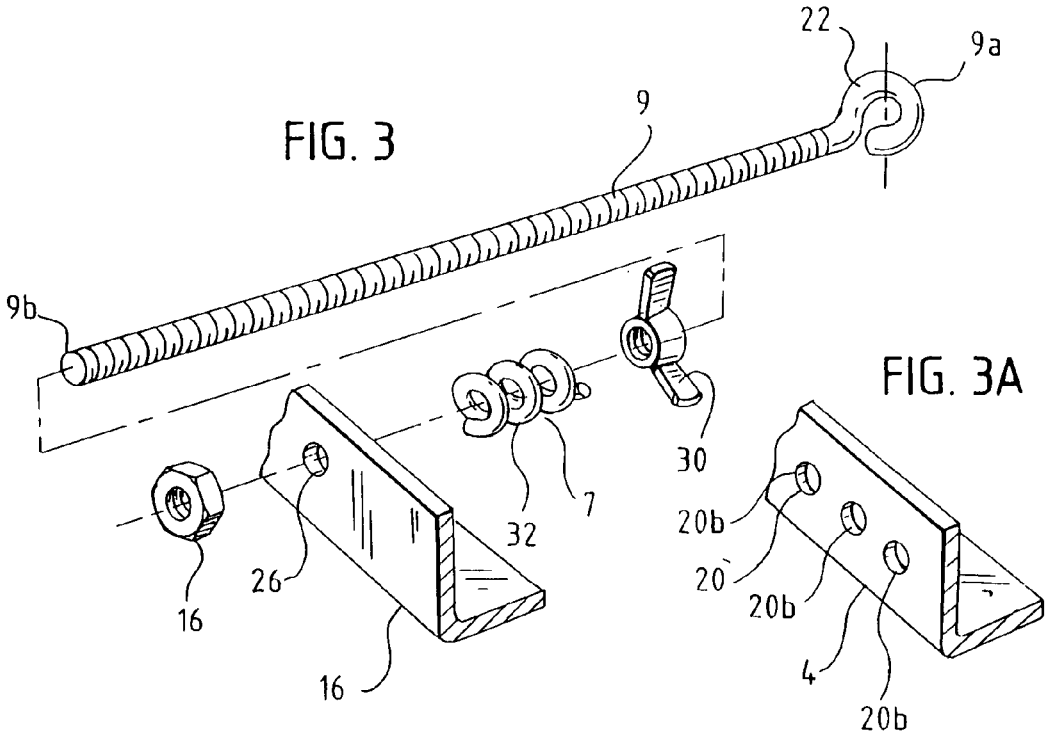
FIG. 3
FIG. 3A
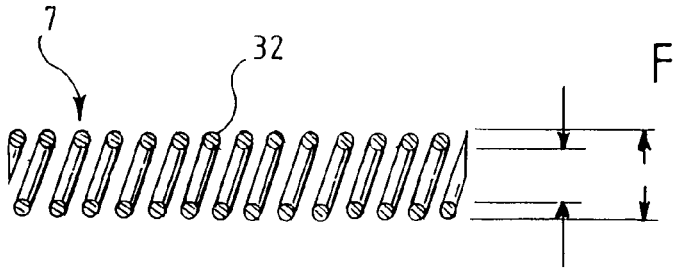
FIG. 4A
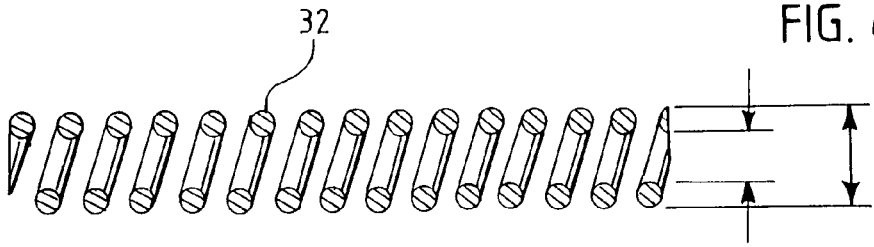
FIG. 4B
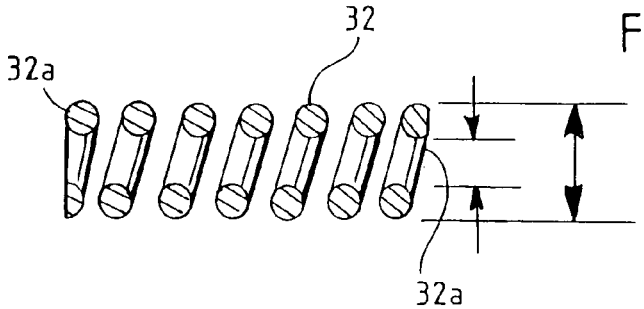
FIG. 4C

HORIZONTAL HOLD DOWN JIG

BACKGROUND OF THE INVENTION

Many woodworking methods such as routing, joining and cutting involve the step of moving a workpiece past a rotating cutting tool. These operations are typically performed on a woodworking machine having a table. Examples of such machines include routertables, shapers, joiners, jointers, and table saws. Examples of rotating cutting tools include saw blades and router bits.

When performing a woodworking operation on a table such as routing, joining and cutting the machine operator must control the path of the workpiece as it moves relative to the cutting tool. The motion of the workpiece is typically guided in whole ore in part by hand. In some cases a motion guide may be utilized to aid the machine operator in guiding the motion of the workpiece. Examples of motion guides include fences, and featherboards.

A fence is typically an elongate metallic member which is fixed to the table of a machine. The fence typically includes an elongate, flat guiding surface which is oriented at a ninety degree angle to the top surface of the table. A workpiece may be held by the hands of the machine operator against the guiding surface of the fence as the workpiece is moved past the cutting tool.

A stop controls the movement of the workpiece by blocking its path. A stop may be used to position a plurality of workpieces in the same longitudinal position so that consistency can be achieved. This is particularly useful for repetitive operations, such as when several pieces of wood must be cut to equivalent length for cabinetry.

A feather board is a motion guide which may be utilized to prevent an occurrence known in the art as kickback. Kickback occurs when the workpiece binds to a cutting tool, for example the blade of a table saw. As a workpiece is cut on a table saw, the blade removes material from the workpiece creating an elongate kerf through the workpiece. Residual stresses within the workpiece sometimes cause the material of the workpiece to close around the blade. A portion of the workpiece may bind to the blade, causing the workpiece to be carried along with the blade as it rotates at high speed. When kickback occurs, the workpiece is thrown upwardly and rearwardly toward the body of the saw operator. The workpiece may strike the unfortunate operator causing bodily injury.

A feather board may include a plurality of pawls. The pawls are typically biased so that they ride over a surface of the workpiece as it is fed in a forward direction past the cutting tool. When a kickback situation arises, the workpiece begins movement in a reverse direction causing a corresponding rotation of the pawls. As the pawls rotate, they may jam the workpiece against a fence mounted on the table of the machine, thereby preventing any further reverse movement.

A table saw or sawbench is the most common piece of large woodworking equipment used by individual craftsmen. Because of its versatility, when only one piece of large woodworking machinery is owned, it will often be a table saw. The saw consists of a circular saw blade, mounted on an arbor, that is driven by an electric motor (either directly or by belt or gears). The blade protrudes through the surface of a table, which provides support for the material (usually wood) being cut.

In modern table saws, the depth of the cut is varied by adjusting the amount of the blade that protrudes above the table surface: the higher the blade protrudes above the table, the deeper the cut that is made in the material. In some early table saws, the blade and arbor were fixed, and the table was moved up and down to expose more or less of the blade. The angle of cut is controlled by adjusting the angle of blade. Some earlier saws angled the table to control the cut angle.

The central tool in almost all cabinetmaking shops is the table saw, probably the most useful single tool the average woodworker is going to have, because the work it does serves as a base for all that comes afterward. Used for sizing wood, the table saw may be seen primarily as a ripping machine, but it does so much else any woodshop without one can seem badly under equipped. Ripping boards to width is one job that is exceptionally important in most projects, but the table saw goes on to cut sheets of plywood, make crosscuts, do miter and bevel cutting and a host of other jobs, just as it comes from its maker. With jigs, the table saw works to make tenons, crosscut wide or very long lumber, make repetitive cuts, cut grooves and slots and molding and much else, including cutting raised panels.

There are two distinct types of router; the plunge router and the fixed (or standard) router. Both types can offer the same end results, although each type is better for particular jobs. The plunge router is especially useful when the routed area begins in the middle of the wood, rather than at the edge. The maximum plunge depth can be set so that you slowly lower the router bit into the wood while keeping the router flat on the wood's surface. While a fixed router can also be used in this example, the router cut depth is fixed and you must hold the router at an angle as you slowly allow the router bit to cut into the wood. This is not as accurate for small routs.

The fixed router is far better for routs along the edge of a piece of wood. The fixed router is also better for any time when the depth of the cut must be very accurate. Fixed routers allow very small increases in the depth of cut and are far more accurate than plunge routers. Further, if you are considering attaching your router to a router table, a plunge router is not suitable. If you only have the budget for one router, we recommend that you start with a fixed router. Routers are typically used to cut grooves, hollow out larger areas and create decorative trims along the edge of a piece of wood. The shapes that can be cut by your router are limited only by the number of router bits that you own.

ADVANTAGES OF THIS INVENTION

This invention relates to a horizontal hold down jig for use in horizontally guiding a piece of wood to be cut on one of a portable table saw and a portable router table having a moveable rip fence. Typically, the rotating cutting wheel will laterally displace the piece of wood being cut. To alleviate this problem, and others which will become apparent from the disclosure which follows, the present invention conveniently can apply a uniform rolling horizontal pressure to the piece of wood being cut to keep it from being laterally displaced.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

According to the invention, a horizontal hold down jig and a kit therefore, for use in horizontally guiding a piece of wood to be cut on one of a portable table saw and a portable router table having a moveable rip fence, comprising a rotatable wheel secured proximate a distal end of a first tension arm, a base plate rotatably connected to a proximate end of the first tension arm, means to secure the base plate of the jig to a table, spreader means for positioning the rotatable wheel at a spaced distance from the base plate when the base plate is secured to the table, and spring biasing means for disposing the rotatable wheel along side the piece of wood, in which the base plate of the jig can be secured to the table with the rotatable wheel disposed in the direction of the piece of wood to be cut, the first tension arm can be adjusted by the spreader means to positioning the rotatable wheel along side the piece of wood, so that the rotatable wheel applies spring biased pressure on the piece of wood before and during the cutting operation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Embodiments of the invention are illustrated by way of example, and not by way of limitation, in the figures of the accompanying drawings and in which like reference numerals refer to similar elements and in which:

FIG. 3 is an exploded perspective view of a threaded rod where the first end can be threadingly engaged to a wing nut, with the rod further being insertable into a compression spring and an aperture in the base plate and a complementary nut;

FIG. 3A is a perspective view of the base plate of the jig showing three horizontally adjacent holes in the base plate serving as the apertures of this configuration for the rod to pass through;

FIGS. 4A, 4B, and 4C show a plurality of compression springs that can be employed with the current invention including ones having a squared ends;

DETAILED DESCRIPTION OF THE INVENTION

Figure 1:
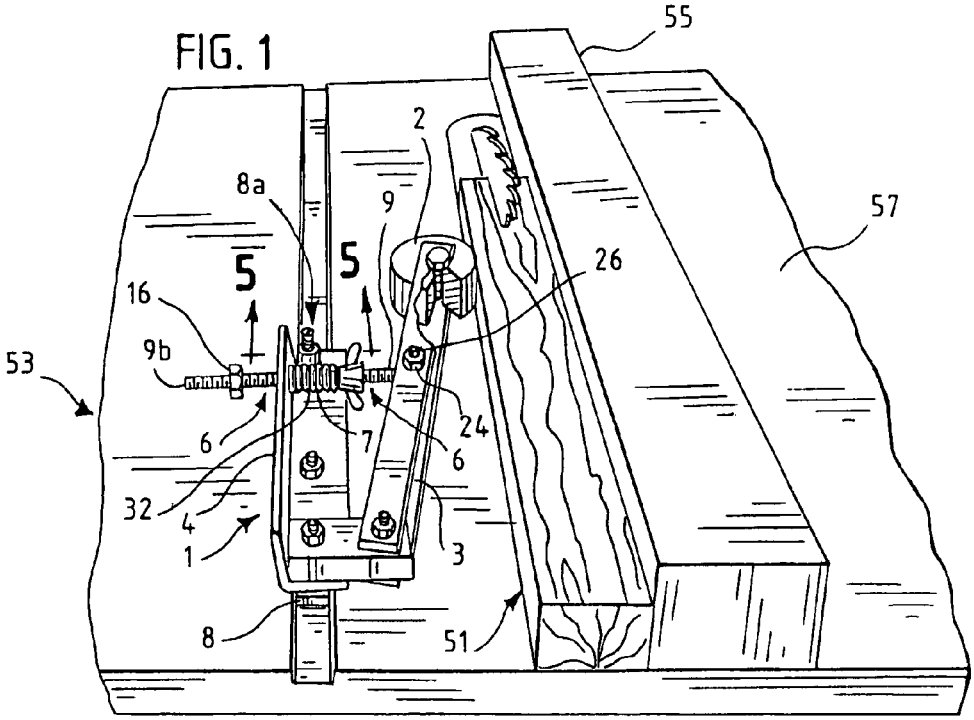
FIG. 1 is a perspective view of a horizontal hold down jig in accordance with the present invention showing the jig in an operative position to hold the piece of wood to be cut adjacent to the fence of the table saw with the jig secured in the miter slot of the table.

In the following description, specific details are set forth in order to provide a thorough understanding of the invention. However, it will be apparent that the invention may be practiced without these specific details.

Without departing from the generality of the invention disclosed herein and without limiting the scope of the invention, the discussion that follows, will refer to the invention as depicted in the drawing.

According to one embodiment, a horizontal hold down jig 1, for use in horizontally guiding a piece of wood 51 to be cut on one of a portable table saw 53 and a portable router table having a moveable rip fence 55, comprising a rotatable wheel 2 secured proximate a distal end of a first tension arm 3, a base plate 4 rotatably connected to a proximate end of the first tension arm, means to secure 5 the base plate 4 of the jig to a table 57, spreader means 6 for positioning the rotatable wheel 2 at a spaced distance from the base plate 4 when the base plate is secured to the table 57, and spring biasing means 7 for disposing the rotatable wheel 2 along side the piece of wood 51 is taught.

In this way, the base plate 4 of the jig 1 can be secured to the table 57 with the rotatable wheel 2 disposed in the direction of the piece of wood 51 to be cut, the first tension arm 3 can be adjusted by the spreader means 6 to positioning the rotatable wheel 2 along side the piece of wood 51, so that the rotatable wheel applies spring biased pressure on the piece of wood before and during the cutting operation.

Preferably, the means to secure 5 the base plate 4 of the jig to a table comprises an elongated bar 8 with an elongated cut 18 extending from a first end that is attached to the underside of the base plate 4 and a first locking screw 10 with a tapered section along a portion of its length and a primary nut 12 for engaging the first screw. The first screw 10 can be disposed in the elongated cut 18 and tightened with the primary nut 12 to encourage a broader portion of the tapered section of the first screw into the elongated cut to spread the first end of the elongated bar 8 to secure the elongated bar in a miter slot 59 of the table 57.

Figure 2:
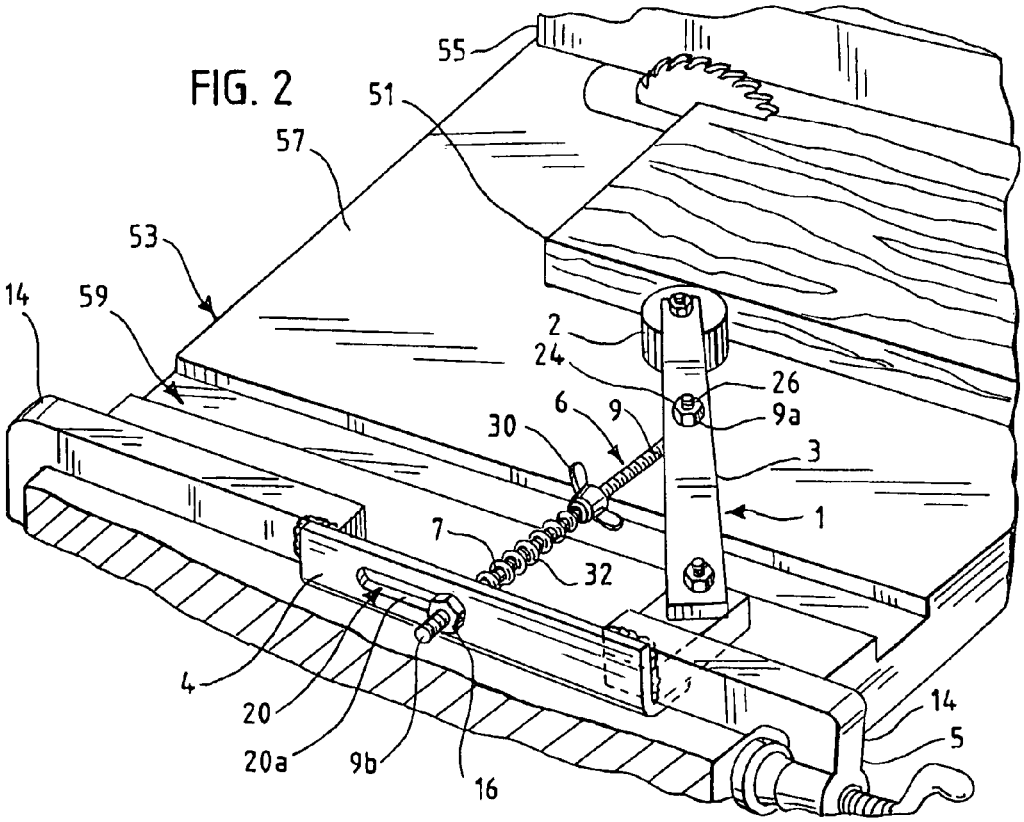
FIG. 2 is another perspective view of the horizontal hold down jig of the current invention showing an elongated slot in the base plate and the jig being held in place by a clamping device.

As shown in FIG. 2, the means to secure 5 the base plate 4 of the jig 1 to a table 57 may comprise at least one clamp 14 tightened to hold the base plate 4 to the table. Moreover, as shown in FIG. 1, the rotatable wheel 2 preferably has a vertical axis and each end of said axis is secured proximate the distal end of the first tension arm 3.

Referring to FIGS. 1 and 2, the spreader means 6 comprises an externally threaded adjustable rod 9 that is pivotally attached on a first end 9*a* of the rod to the first tension arm 3 and that engages an aperture 20 in the base plate 4 that is suitably sized to receive the rod 9, and a complementary nut 16 and a wing nut 30 suitably sized to engage the threaded rod 9, said complementary nut and wing nut can respectively be disposed on either side of the aperture 20 of the base plate 4 to limit the range of pivotal movement of the first tension arm 3 relative to the base plate 4. FIG. 2 shows the aperture 20 comprising an elongated slot. Alternatively, the aperture 20 may comprise a plurality of horizontally adjacent holes, as shown in FIG. 3A.

Moreover, the spreader means 6, as shown in FIGS. 1-3, comprises an externally threaded rod 9 with an eyelet 22 disposed on a first end 9*a*, a first nut 24 and bolt 26, at least one hole 28 in the first tension arm 3 that is suitably sized to receive the bolt 26, at least on aperture 20 in the base plate 4 that is suitably sized to receive the rod 9, a complementary nut 16 and a wing nut 30 suitably sized to engage the threaded rod 9, said complementary nut and wing nut can respectively be disposed on either side of the aperture 20 of the base plate 4 to limit the range of pivotal movement of the first tension arm relative to the base plate.

Additionally, the spring biasing means 7 may comprise at least one compression spring 32 suitably sized to stabilize the piece of wood 51 to be cut with the rotatable wheel 2. Preferably, the spring biasing means comprises one of a plurality of compression springs 32 from a group of compression springs of varying compressive strength characteristics which are suitably sized to laterally stabilize a piece of wood to be cut on a table with the rotatable wheel from a group of pieces of wood of varying consistency, wood grain angle, feed cutting speed, width, and thickness or depth of cut, as shown in FIG. 4.

As is evident in FIGS. 1-3, the spring biasing means 7 may be integrally connected to the spreader means 6. As shown in FIG. 3-4, the spring biasing means 7 may comprise a compression coil spring 32 having an internal radius and the spreader means 6 comprises an externally threaded rod 9 that is pivotally attached on a first end 9*a* of the rod to the first tension arm 3 and that is suitably sized to pass through the internal radius of the coil spring 32 and through an aperture 20 in the base plate 4, and a complementary nut 16 and a wing nut 30 each having an internal thread that is suitably sized to engage the threaded rod 9 and each having a transverse dimension that is larger than the aperture 20, said wing nut 30 being threaded onto the rod 9 to allow a second end 9*b* of the rod to pass through the internal radius of the coil spring 32 and then through the aperture 20, and the complementary nut 16 being disposed onto the second end 9*b* of the rod to limit the range of pivotal movement of the first tension arm 3 relative to the base plate 4. Furthermore, locating the wing nut 30 further from the first end 9*a* of the rod increases the pressure of the rotatable wheel 2 on the piece of wood 51 to be cut, whereas, locating the wing nut 30 closer to the first end 9*a* of the rod allows a wider piece of wood to be cut. To adjust for lateral pressure needs to keep the workpiece aligned, another spring 32 having different compressive strength characteristics may be employed.

Preferably, the spring biasing means 7 of the jig 1 has one of a plurality of compression springs 32 from a group of compression springs of varying compressive strength characteristics that can be interchanged on the jig to laterally stabilize the piece of wood to be cut on the table.

A preferred embodiment of the horizontal hold down jig, for use in horizontally guiding a piece of wood to be cut on one of a portable table saw and a portable router table having a moveable rip fence, has:

a. a rotatable wheel 2 secured proximate a distal end 3*a* of a first tension arm, said wheel 2 having a vertical axis and each end of said axis is secured proximate the distal end of the first tension arm 3;

b. a base plate 4 rotatably connected to a proximate end 3*b* of the first tension arm 3;

c. means to secure 5 the base plate 4 of the jig 1 to a table 57 comprises one of an elongated bar 8 with an elongated cut 18 extending from a first end 8*a* that is attached to the underside of the base plate 4 and a first screw 10 with a tapered section along a portion of its length and a primary nut 12 for engaging the first screw, said first screw can be disposed in the elongated cut 18 and tightened with the primary nut 12 to encourage a broader portion of the tapered section of the first screw 10 into the elongated cut 18 to spread the first end of the elongated bar 8 to secure the elongated bar in a miter slot 59 of the table 57, and at least one clamp 14 tightened to hold the base plate 4 to the table;

d. spreader means 6 for positioning the rotatable wheel at a spaced distance from the base plate when the base plate is secured to the table, said spreader means comprising an externally threaded rod 9 that is pivotally attached on a first end 9*a* of the rod 9 to the first tension arm 3 and that engages an aperture 20 in the base plate 4 that is suitably sized to receive the rod 9, and a complementary nut 16 and a wing nut 30 suitably sized to engage the threaded rod 9, said complementary nut and wing nut can respectively be disposed on either side of the aperture of the base plate 4 to limit the range of pivotal movement of the first tension arm 3 relative to the base plate 4;

e. spring biasing means 7, for disposing the rotatable wheel 2 along side the piece of wood 51, comprising one of a plurality of compression springs 32 from a group of compression springs of varying compressive strength characteristics which are suitably sized to laterally stabilize a piece of wood to be cut on a table with the rotatable wheel from a group of pieces of wood of varying consistency, wood grain angle, feed cutting speed, width, and thickness or depth of cut; and f. said spring biasing means 7 being integrally connected to the spreader means 6, whereby, the base plate 4 of the jig 1 can be secured to the table 57 with the rotatable wheel 2 disposed in the direction of the piece of wood 51 to be cut, the first tension arm 3 can be adjusted by the spreader means 6 to positioning the rotatable wheel 2 along side the piece of wood, so that the rotatable wheel applies spring biased pressure on the piece of wood before and during the cutting operation.

Preferably, the spring biasing means 7 comprises a compression coil spring 32 having an internal radius and the spreader means 6 comprises an externally threaded rod 9 that is pivotally attached on a first end 9*a* of the rod to the first tension arm 2 and that is suitably sized to pass through the internal radius of the coil spring 32 and through an aperture 20 in the base plate, and a complementary nut 16 and a wing nut 30 each having an internal thread that is suitably sized to engage the threaded rod 9 and each having a transverse dimension that is larger than the aperture 20, said wing nut 30 being threaded onto the rod 9 to allow a second end 9*b* of the rod to pass through the internal radius of the coil spring 32 and then through the aperture 20, and the complementary nut 16 being disposed onto the second end 9*b* of the rod to limit the range of pivotal movement of the first tension arm relative to the base plate.

Figure 5:
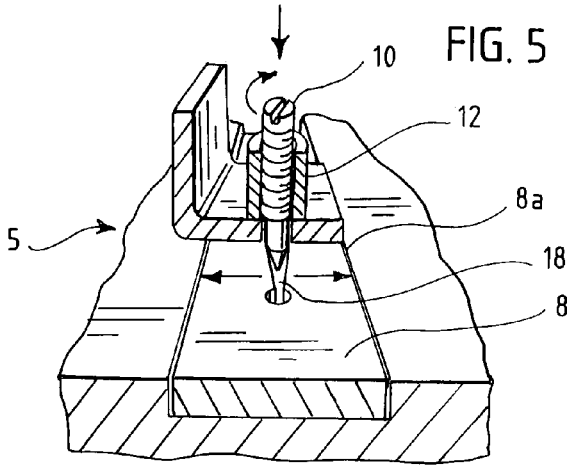
FIG. 5 is a cross-sectional view taken along the line 5-5 of FIG. 1 showing details of the means to secure the jig to a table comprising an elongated bar with an elongated cut on a first end with a first tapered screw and primary nut to spread the first end of the elongated bar to secure the jig to the table.

Additionally, as shown in FIG. 5, a kit 34 for laterally stabilize the piece of wood 51 to be cut on the table 57 is taught by this important invention. The kit 34 comprises a horizontal hold down jig 1 having a rotatable wheel 2 secured proximate a distal end 3*a* of a first tension arm 3, a base plate 4 rotatably connected to a proximate end 3*b* of the first tension arm, means to secure 5 the base plate 4 of the jig to a table, spreader means 6 comprising an externally threaded rod 9 that is pivotally attached on a first end 9*a* of the rod to the first tension arm 3 and that engages an aperture 20 in the base plate 4 that is suitably sized to receive the rod 9, and a complementary nut 16 and a wing nut 30 each having an internal thread that is suitably sized to engage the threaded rod 9 and each having a transverse dimension that is larger than the aperture 20, said wing nut 30 being threaded onto the rod 9 to allow a second end 9*b* of the rod to pass through the internal radius of the coil spring 32 and then through the aperture 20, and the complementary nut 16 being disposed onto the second end 9*b* of the rod to limit the range of pivotal movement of the first tension arm 3 relative to the base plate 4, spring biasing means 7 for disposing the rotatable wheel 2 along side the piece of wood 51, for horizontally guiding the piece of wood to be cut on one of a portable table saw and a portable router table having a moveable rip fence 55, and a plurality of compression springs 32 from a group of compression springs having a transverse dimension that is larger than the aperture 20 and having varying axial lengths and compressive strength characteristics that can be interchanged on the jig 1.

The kit 34 preferably has each of the compression springs 32 from the group of compression springs has squared ends 32*a* which will minimize distortion and the bending of the axis of the spring 32. This aspect of the invention coupled with an aperture 20 comprising either an elongated slot 20*a* or a plurality of horizontally adjacent holes 20*b* will allow the rod 9 to maintain perpendicularity with the base plate 4 of the jig 1, to minimize distortion and the bending of the axis of the spring 32.

Figure 7:
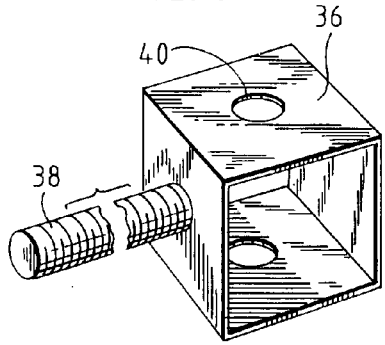
FIG. 7 is a detailed perspective view of a rod securing attachment as shown in FIG. 6.
Figure 6:
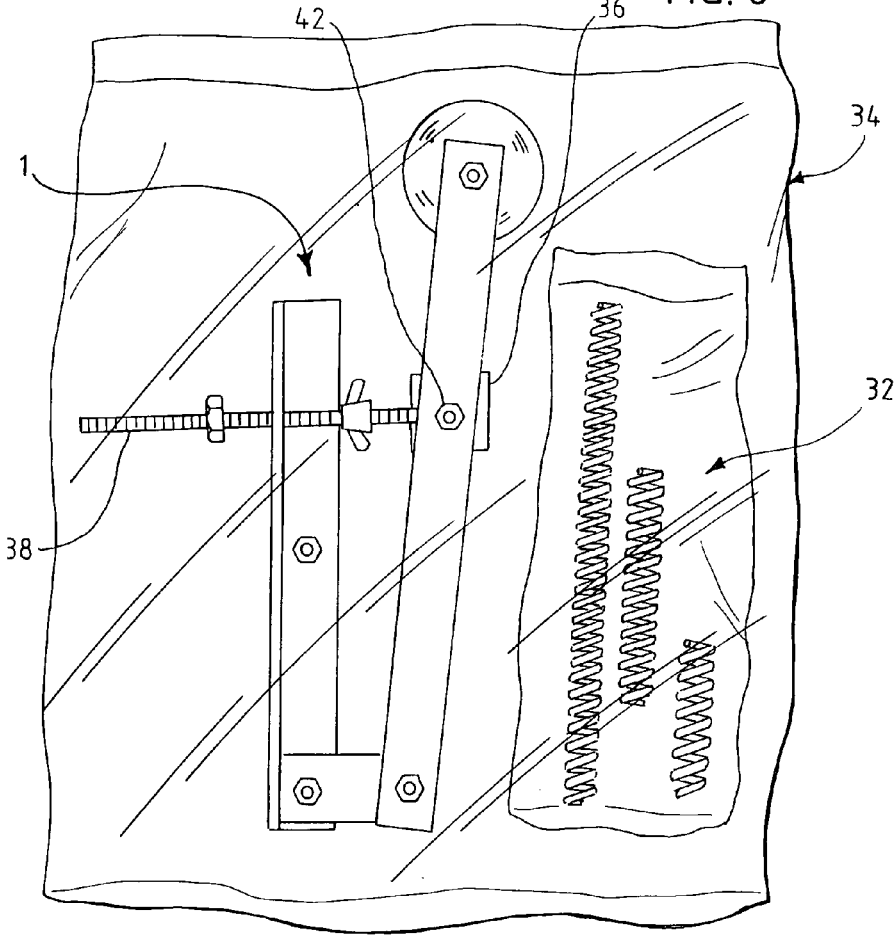
FIG. 6 is a perspective view of a kit for laterally stabilizing a piece of wood to be cut on a table which includes the jig with a plurality of compression springs with transverse dimensions that are larger than the aperture and having variable axial lengths and compressive strength characteristics that are used interchangeably as part of the jig.

FIG. 7 is a detailed perspective view of a rod securing attachment 36 as shown in FIG. 6. The attachment 36 is secured to an adjustable threaded rod 38, which functions as described previously. The rod 38 can be secured to the attachment 36 by any suitable mechanism, such as a welding or threaded coupling. A pair of aligned holes 40 permit the insertion and securing of a nut and bolt assembly 42 in such a way as to permit the mechanism to pivot, as previously described.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A horizontal hold down jig, for use in horizontally guiding a piece of wood to be cut on one of a portable table saw and a portable router table having a moveable rip fence, comprising:

a. a rotatable wheel secured proximate a distal end of a first tension arm;

b. a base plate rotatably connected to a proximate end of the first tension arm;

c. means for securing the base plate of the jig to a table;

d. spreader means for positioning the rotatable wheel at a spaced distance from the base plate when the base plate is secured to the table; and e. spring biasing means for disposing the rotatable wheel along side the piece of wood, whereby, when the base plate of the jig is secured to the table with the rotatable wheel disposed in the direction of the piece of wood to be cut, the first tension arm is adjusted by the spreader means to positioning the rotatable wheel along side the piece of wood, so that the rotatable wheel applies spring biased pressure on the piece of wood before and during the cutting operation.

2. The horizontal hold down jig of claim 1, in which the means for securing the base plate of the jig to a table comprises an elongated bar with an elongated cut extending from a first end of the bar that is attached to the underside of the base plate and a first screw with a tapered section along a portion of the length of the first screw and a primary nut for engaging the first screw, said first screw is disposed in the elongated cut and tightened with the primary nut to encourage a broader portion of the tapered section of the first screw into the elongated cut to spread the first end of the elongated bar to secure the elongated bar in a miter slot of the table.

3. The horizontal hold down jig of claim 1, in which the means for securing the base plate of the jig to a table comprises at least one clamp tightened to hold the base plate to the table.

4. The horizontal hold down jig of claim 1, in which the rotatable wheel has a vertical axis and each end of said axis is secured proximate the distal end of the first tension arm.

5. The horizontal hold down jig of claim 1, in which the spreader means comprises an externally threaded rod that is pivotally attached on a first end of the rod to the first tension arm and that engages an aperture in the base plate that is suitably sized to receive the rod, and a complementary nut and a wing nut suitably sized to engage the threaded rod, said complementary nut and wing nut is respectively be disposed on either side of the aperture of the base plate to limit the range of pivotal movement of the first tension arm relative to the base plate.

6. The horizontal hold down jig of claim 5, in which the aperture comprises an elongated slot.

7. The horizontal hold down of jig of claim 1, in which the spreader means comprises an externally threaded rod with an eyelet disposed on a first end, a first nut and bolt, at least one hole in the first tension arm that is suitably sized to receive the bolt, at least on aperture in the base plate that is suitably sized to receive the rod, a complementary nut and a wing nut suitably sized to engage the threaded rod, said complementary nut and wing nut is respectively be disposed on either side of the aperture of the base plate to limit the range of pivotal movement of the first tension arm relative to the base plate.

8. The horizontal hold down jig of claim 7, in which the aperture comprises an elongated slot.

9. The horizontal hold down jig of claim 7, in which the aperture comprises a plurality of horizontally adjacent holes.

10. The horizontal hold down jig of claim 1, in which the spring biasing means comprises at least one compression spring suitably sized to stabilize the piece of wood to be cut with the rotatable wheel.

11. The horizontal hold down jig of claim 1, in which the spring biasing means comprises one of a plurality of compression springs from a group of compression springs of varying compressive strength characteristics which are suitably sized to laterally stabilize a piece of wood to be cut on a table with the rotatable wheel from a group of pieces of wood of varying consistency, wood grain angle, feed cutting speed, width, and thickness or depth of cut.

12. The horizontal hold down jig of claim 1, in which the spring biasing means is connected to the spreader means.

13. The horizontal hold down jig of claim 12, in which the spring biasing means comprises a compression coil spring having an internal radius and the spreader means comprises an externally threaded rod that is pivotally attached on a first end of the rod to the first tension arm and that is suitably sized to pass through the internal radius of the coil spring and through an aperture in the base plate, and a complementary nut and a wing nut each having an internal thread that is suitably sized to engage the threaded rod and each having a transverse dimension that is larger than the aperture, said wing nut being threaded onto the rod to allow a second end of the rod to pass through the internal radius of the coil spring and then through the aperture, and the complementary nut being disposed onto the second end of the rod to limit the range of pivotal movement of the first tension arm relative to the base plate.

14. The horizontal hold down jig of claim 13, in which locating the wing nut further from the first end of the rod increases the pressure of the rotatable wheel on the piece of wood to be cut.

15. The horizontal hold down jig of claim 13, in which locating the wing nut closer to the first end of the rod allows a wider piece of wood to be cut.

16. The horizontal hold down jig of claim 13, in which the spring biasing means comprises one of a plurality of compression springs from a group of compression springs of varying compressive strength characteristics that can be interchanged on the jig to laterally stabilize the piece of wood to be cut on the table.

17. A horizontal hold down jig, for use in horizontally guiding a piece of wood to be cut on one of a portable table saw and a portable router table having a moveable rip fence, having:

a. a rotatable wheel secured proximate a distal end of a first tension arm, said wheel having a vertical axis and each end of said axis is secured proximate the distal end of the first tension arm;

b. a base plate rotatably connected to a proximate end of the first tension arm;

c. means for securing the base plate of the jig to a table comprises one of an elongated bar with an elongated cut extending from a first end that is attached to the underside of the base plate and a first screw with a tapered section along a portion of the length of the first screw and a primary nut for engaging the first screw, said first screw is disposed in the elongated cut and tightened with the primary nut to encourage a broader portion of the tapered section of the first screw into the elongated cut to spread the first end of the elongated bar to secure the elongated bar in a miter slot of the table, and at least one clamp tightened to hold the base plate to the table;

d. spreader means for positioning the rotatable wheel at a spaced distance from the base plate when the base plate is secured to the table, said spreader means comprising an externally threaded rod that is pivotally attached on a first end of the rod to the first tension arm and that engages an aperture in the base plate that is suitably sized to receive the rod, and a complementary nut and a wing nut suitably sized to engage the threaded rod, said complementary nut and wing nut is respectively be disposed on either side of the aperture of the bas plate to limit the range of pivotal movement of the first tension arm relative to the base plate;

e. spring biasing means, for disposing the rotatable wheel along side the piece of wood, comprising one of a plurality of compression springs from a group of compression springs of varying compressive strength characteristics which are suitably sized to laterally stabilize a piece of wood to be cut on a table with the rotatable wheel from a group of pieces of wood of varying consistency, wood grain angle, feed cutting speed, width, and thickness or depth of cut; and f. said spring biasing means being integrally connected to the spreader means whereby, the base plate of the jig can be secured to the table with the rotatable wheel disposed in the direction of the piece of wood to be cut, the first tension arm is adjusted by the spreader means to positioning the rotatable wheel along side the piece of wood, so that the rotatable wheel applies spring biased pressure on the piece of wood before and during the cutting operation.

18. The horizontal hold down jig of claim 17, in which the spring biasing means comprises a compression coil spring having an internal radius and the spreader means comprises an externally threaded rod that is pivotally attached on a first end of the rod to the first tension arm and that is suitably sized to pass through the internal radius of the coil spring and through an aperture in the base plate, and a complementary nut and a wing nut each having an internal thread that is suitably sized to engage the threaded rod and each having a transverse dimension that is larger than the aperture, said wing nut being threaded onto the rod to allow a second end of the rod to pass through the internal radius of the coil spring and then through the aperture, and the complementary nut being disposed onto the second end of the rod to limit the range of pivotal movement of the first tension arm relative to the base plate.

19. A kit for laterally stabilize the piece of wood to be cut on the table, the kit comprising:

a. a horizontal hold down jig having a rotatable wheel secured proximate a distal end of a first tension arm, a base plate rotatably connected to a proximate end of the first tension arm, means for securing the base plate of the jig to a table, spreader means comprising an externally threaded rod that is pivotally attached on a first end of the rod to the first tension arm and that engages an aperture in the base plate that is suitably sized to receive the rod, and a complementary nut and a wing nut each having an internal thread that is suitably sized to engage the threaded rod and each having a transverse dimension that is larger than the aperture, said wing nut being threaded onto the rod to allow a second end of the rod to pass through the internal radius of the coil spring and then through the aperture, and the complementary nut being disposed onto the second end of the rod to limit the range of pivotal movement of the first tension arm relative to the base plate, spring biasing means for disposing the rotatable wheel along side the piece of wood, for horizontally guiding the piece of wood to be cut on one of a portable table saw and a portable router table having a moveable rip fence; and b. a plurality of compression springs from a group of compression springs having a transverse dimension that is larger than the aperture and having varying axial lengths and compressive strength characteristics that can be interchanged on the jig.

20. The kit of compression springs of claim 19, in which each of the compression springs has squared ends.

* * * * *